US009476631B2

(12) United States Patent
Park et al.

(10) Patent No.: US 9,476,631 B2
(45) Date of Patent: Oct. 25, 2016

(54) ICE MAKING DEVICE AND REFRIGERATOR HAVING THE SAME

(75) Inventors: Kyoung Ki Park, Gwangju (KR); Ji Hoon Kim, Gwangju (KR); Sang Min Park, Gwangju (KR); Jae Jio Lee, Gwangju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 199 days.

(21) Appl. No.: 13/337,872

(22) Filed: Dec. 27, 2011

(65) Prior Publication Data

US 2012/0174613 A1 Jul. 12, 2012

(30) Foreign Application Priority Data

Jan. 10, 2011 (KR) ..... 10-2011-0002108

(51) Int. Cl.

| | |
|---|---|
| ***F25C 5/02*** | (2006.01) |
| ***F25C 5/18*** | (2006.01) |
| ***F25C 5/04*** | (2006.01) |
| ***F25C 5/00*** | (2006.01) |
| *F25D 17/06* | (2006.01) |

(52) U.S. Cl.

CPC ..... *F25C 5/046* (2013.01); *F25C 5/005* (2013.01); *F25C 2400/10* (2013.01); *F25D 17/065* (2013.01); *F25D 2317/061* (2013.01); *F25D 2317/063* (2013.01); *F25D 2317/067* (2013.01)

(58) Field of Classification Search

CPC .... F25C 5/046; F25C 5/005; F25C 2400/10; F25D 17/065; F25D 2317/061; F25D 2317/067; F25D 2317/063

USPC ..... 62/344, 354, 353, 425, 420, 406, 410

See application file for complete search history.

(56) References Cited

U.S. PATENT DOCUMENTS

| | | | | |
|---|---|---|---|---|
| 6,607,150 | B1 * | 8/2003 | Izutsu | B02C 23/24 241/18 |
| 2006/0248912 | A1 * | 11/2006 | Park et al. | 62/344 |
| 2007/0119194 | A1 * | 5/2007 | Kim et al. | 62/135 |
| 2008/0034779 | A1 * | 2/2008 | Lee | F25C 1/04 62/344 |
| 2008/0034780 | A1 * | 2/2008 | Lim et al. | 62/353 |
| 2008/0053138 | A1 * | 3/2008 | Ryu et al. | 62/344 |
| 2008/0104977 | A1 * | 5/2008 | Coulter | F25D 11/02 62/132 |

(Continued)

FOREIGN PATENT DOCUMENTS

| | | |
|---|---|---|
| CN | 1858524 | 11/2006 |
| CN | 101000200 | 7/2007 |

(Continued)

OTHER PUBLICATIONS

Extended European Search Report dated May 21, 2012 issued in corresponding European Patent Application No. 12150032.6.

Chinese Office Action issued Feb. 16, 2015 in corresponding Chinese Patent Application No. 201210022840.9.

*Primary Examiner* — M. Alexandra Elve
*Assistant Examiner* — Kun Kai Ma
(74) *Attorney, Agent, or Firm* — Staas & Halsey LLP

(57) ABSTRACT

A refrigerator includes a separate cool air supply channel formed in an ice making chamber door so as to supply cool air to a crushing chamber formed in the ice making chamber door, which is connected to the front portion of an ice bank storing ice dropped from an ice making tray, to open and close an ice making chamber, thereby preventing ice remaining in the crushing chamber from melting.

18 Claims, 6 Drawing Sheets

(56) References Cited

U.S. PATENT DOCUMENTS

| | | | | |
|---|---|---|---|---|
| 2010/0199701 | A1* | 8/2010 | Yoon et al. | 62/344 |
| 2010/0300137 | A1 | 12/2010 | Lim et al. | |

FOREIGN PATENT DOCUMENTS

| | | |
|---|---|---|
| CN | 101900470 | 12/2010 |
| EP | 2159516 | 3/2010 |

* cited by examiner

ICE MAKING DEVICE AND REFRIGERATOR HAVING THE SAME

CROSS-REFERENCE TO RELATED APPLICATIONS

This application claims the benefit of Korean Patent Application No. 10-2011-0002108, filed on Jan. 10, 2011 in the Korean Intellectual Property Office, the disclosure of which is incorporated herein by reference.

BACKGROUND

1. Field

Embodiments of the present disclosure relate to a refrigerator having an ice making device to supply ice to a dispenser.

2. Description of the Related Art

In general, a refrigerator is an apparatus which supplies cool air of a low temperature to storage chambers in which food is stored so as to store the food at a low temperature under a fresh state, and includes a freezing chamber, the inside of which is maintained at a temperature under the freezing point, and a refrigerating chamber, the inside of which is maintained at a temperature slightly above the freezing point.

Recently, large-scale refrigerators have been launched according to necessities of convenience and a large storage space, and refrigerators are classified into a general refrigerator, a side by side refrigerator and a combination-type refrigerator according to dispositions of freezing and refrigerating chambers and structures of doors.

Further, a dispenser is provided on a door of a refrigerator so as to supply ice or water to a user at the outside of the refrigerator, and an ice making device to supply ice to the dispenser is provided in a storage chamber.

The ice making device is installed in an ice making chamber separated from a refrigerating chamber by a separate insulating diaphragm or a freezing chamber according to dispositions of the storage chambers, and ice generated by the ice making device is transferred to a space provided with an ice outlet communicating with the dispenser through an ice transfer device and is then transferred to the dispenser through the ice outlet.

SUMMARY

Therefore, it is an aspect of the present disclosure to provide an ice making device which prevents water formed from melting of ice remaining in a space at the side of an ice outlet communicating with the dispenser from falling into a dispenser, and a refrigerator having the same.

Additional aspects of the disclosure will be set forth in part in the description which follows and, in part, will be apparent from the description, or may be learned by practice of the disclosure.

In accordance with one aspect of the present disclosure, a refrigerator includes a main body including a refrigerating chamber, a door including a dispenser to dispense ice and provided to open and close the refrigerating chamber, an ice making chamber provided in the refrigerating chamber so as to be divided from the refrigerating chamber by an insulating diaphragm, a cool air channel provided in the main body so as to circulate cool air in the ice making chamber, an ice maker provided in the ice making chamber and including an ice making tray to generate ice due to cool air supplied to the ice making chamber, an ice making chamber door provided to open and close the ice making chamber and including an ice bank to store ice separated from the ice making tray, and a crushing chamber forming a separate space in the ice making chamber door and including an ice crushing device to crush ice discharged from the ice bank to the dispenser, wherein a cool air supply channel to supply a part of the cool air supplied to the ice making chamber to the crushing chamber is provided in the ice making chamber door.

The refrigerator may further include an ice transfer device to transfer the ice stored in the ice bank to the crushing chamber, and an ice path to supply the ice transferred by the ice transfer device to the crushing chamber may be provided on the rear surface of the ice making chamber door.

An ice movement path to drop ice toward the dispenser may be provided in the door, and the crushing chamber may be provided with an ice outlet communicating with the ice movement path.

The cool air supply channel may be formed above the crushing chamber such that one end of the cool air supply channel communicates with the crushing chamber and the other end of the cool air supply channel communicates with the ice making chamber.

The refrigerator may further include a cool air guide to guide the cool air supplied to the ice making chamber so that the cool air contacts the lower surface of the ice making tray.

The refrigerator may further include a cool air guide member installed on the rear surface of the ice making chamber door so as to guide a part of cool air discharged from the cool air guide to the cool air supply channel.

The ice maker and the ice making chamber door may be separated from each other by a designated distance if the ice making chamber door closes the ice making chamber, and the cool air guide member may include a cover part provided with cool air passing holes and covering the upper surface of the ice bank due to the separation between the ice maker and the ice making chamber door.

The cool air guide member may further include ice separation ribs extended from the lower surface of the cover part.

The ice making chamber door may include an insulating material installed between an outer casing and an inner casing, and the crushing chamber may be formed by a crushing chamber housing connected between the insulating material and the inner casing.

The cool air supply channel may include at least one cool air introduction hole formed at the upper portion of the inner casing, at least one cool air discharge hole formed at the upper portion of the crushing chamber housing, and a connection channel formed in the insulating material so as to connect the at least one cool air introduction hole and the at least one cool air discharge hole.

In accordance with another aspect of the present disclosure, an ice making device installed in an ice making chamber provided in a refrigerating chamber such that the ice making chamber is divided from the refrigerating chamber by an insulating diaphragm to form an independent space, includes an ice maker to freeze water stored in an ice making tray into ice, an ice bank to store ice separated from the ice making tray, a crushing chamber forming a closed space divided from the ice bank and provided with an ice outlet to discharge ice, an ice transfer device installed in the ice bank so as to transfer the ice stored in the ice bank to the crushing chamber, an ice path formed between the ice bank and the crushing chamber so as to supply the ice transferred by the ice transfer device to the crushing chamber, and a cool air supply channel connecting the ice bank and the crushing chamber to supply a part of the cool air having cooled the ice making tray to the crushing chamber.

An ice crushing device to crush the ice supplied by the ice transfer device may be provided in the crushing chamber.

The ice making device may further include a cool air guide disposed below the ice making tray to guide the supplied cool air so that the cool air contacts the lower surface of the ice making tray.

The cool air supply channel may include at least one cool air introduction hole formed at the upper portion of a diaphragm provided with the ice path, at least one cool air discharge hole formed at the upper portion of the crushing chamber, and a connection channel formed in an insulating material surrounding the crushing chamber so as to connect the at least one cool air introduction hole and the at least one cool air discharge hole.

A cool air guide member to guide cool air, discharged to a portion above the ice path by the cool air guide, to the at least one cool air introduction hole may be installed on the diaphragm.

The cool air guide member may include a cover part extended from the diaphragm to the ice maker, and cool air passing holes to pass cool air may be formed on the cover part.

The cool air guide member may further include ice separation ribs extended from the lower surface of the cover part so as to prevent the cool air passing holes from being clogged with ice accumulated around the ice path.

In accordance with a further aspect of the present disclosure, a refrigerator includes a main body in which a storage chamber is formed, a door including a dispenser and an ice movement path to transfer ice to the dispenser and provided to open and close the storage chamber, an ice making chamber provided in the refrigerating chamber to form an independent space divided from the refrigerating chamber, an ice making device installed in the ice making chamber and including an ice maker to generate ice, an ice bank disposed below the ice maker and provided with an ice transfer device to transfer ice, an ice path into which the ice transferred by the ice transfer device is introduced, and a crushing chamber provided with an ice outlet connected to the ice movement path and divided from the ice bank, and a cool air supply channel provided with one end communicating with the crushing chamber and the other end communicating with a space in which the ice maker is disposed and supplying a part of cool air having cooled the ice maker to the crushing chamber so as to prevent ice remaining in the crushing chamber and the ice movement path from melting.

The ice maker may further include an ice making tray to contain water to be frozen into ice, and a cool air guide disposed below the ice making tray to guide the supplied cool air so that the cool air contacts the lower surface of the ice making tray.

The refrigerator may further include an insulating material provided at the outside of the crushing chamber, and the cool air supply channel may include at least one cool air introduction hole communicating with the ice making chamber, at least one cool air discharge hole communicating with the crushing chamber, and a connection channel formed in the insulating material so as to connect the at least one cool air introduction hole and the at least one cool air discharge hole.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
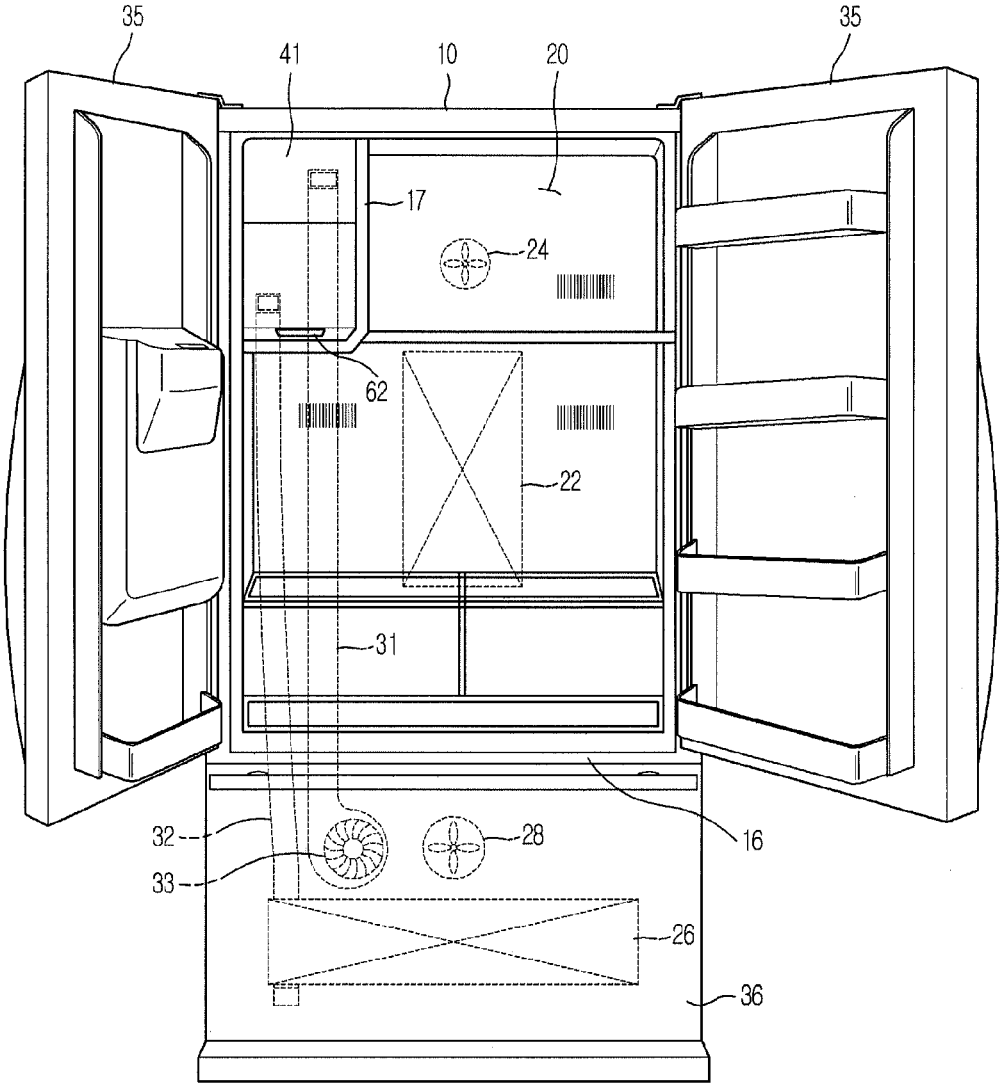
FIG. 1 is a perspective view illustrating the internal structure of a refrigerator in accordance with one embodiment of the present disclosure in a state in which doors are opened.

Reference will now be made in detail to the embodiments of the present disclosure, examples of which are illustrated in the accompanying drawings, wherein like reference numerals refer to like elements throughout.

Figure 2:
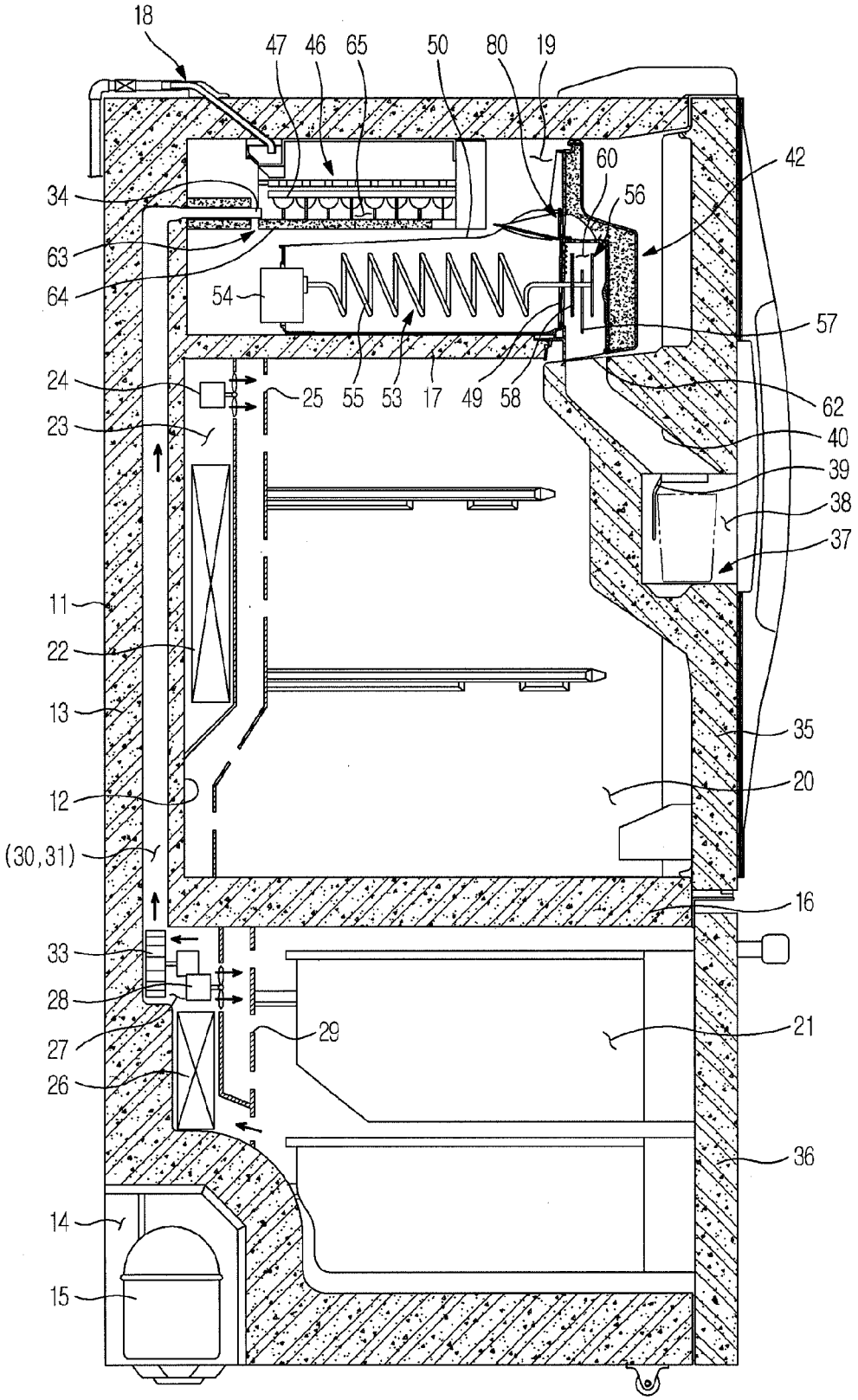
FIG. 2 is a cross-sectional view of the refrigerator in accordance with the embodiment of the present disclosure.

FIG. 1 is a perspective view illustrating the internal structure of a refrigerator in accordance with one embodiment of the present disclosure in a state in which doors are opened and FIG. 2 is a cross-sectional view of the refrigerator in accordance with the embodiment of the present disclosure.

With reference to FIGS. 1 and 2, the refrigerator in accordance with this embodiment includes a main body 10 having a plurality of storage chambers and doors 35 and 36 installed on the main body 10 to open and close the plurality of storage chambers.

The main body 10 includes an outer casing 11 forming the outer surface of the main body 10, an inner casing 12 disposed at a regular interval with the outer casing 11 to form the storage chambers therein, and a foamed insulating material 13 filling a space between the outer casing 11 and the inner casing 12.

A machinery chamber 14 in which electric parts including a compressor 15 are installed is provided at the lower portion of the rear region of the main body 10.

The storage chambers include a refrigerating chamber 20 disposed at the upper portion of the main body 10 and a freezing chamber 21 disposed at the lower portion of the main body 10, and the refrigerating chamber 20 and the freezing chamber 21 are divided by a horizontal diaphragm 16.

A first cool air channel 23 in which a first evaporator 22 to cool the refrigerating chamber 20 is installed is provided at the rear portion of the refrigerating chamber 20, and a second cool air channel 27 in which a second evaporator 26 to cool the freezing chamber 21 is installed is provided at the rear portion of the freezing chamber 21.

A first circulation fan 24 to circulate cool air within the refrigerating chamber 20 is installed at the upper portion of the first cool air channel 23. The first circulation fan 24 sucks cool air having cooled the refrigerating chamber 20 and supplies the cool air having passed through the first evaporator 22 to the refrigerating chamber 20 through a plurality of discharge holes 25, thereby circulating the cool air within the refrigerating chamber 20.

A second circulation fan 28 to circulate cool air within the freezing chamber 21 is installed at the upper portion of the second cool air channel 27. The second circulation fan 28 sucks cool air having cooled the freezing chamber 21 and supplies the cool air having passed through the second evaporator 26 to the freezing chamber 21 through a plurality of discharge holes 29, thereby circulating the cool air within the freezing chamber 21.

Further, an ice making chamber 19 which is divided from the refrigerating chamber 20 by an insulating wall 17 and forms an independent space separately from the refrigerating chamber 20 is provided at one side of the upper portion of the refrigerating chamber 20.

An ice making device 41 to freeze water supplied by a water supply device 18 into ice is installed in the ice making chamber 19, and a third cool air channel 30 to supply cool air to the ice making chamber 19 is installed at the rear portion of the ice making chamber 19.

The ice making device 41 includes an ice making tray 47 which contains the supplied water to freeze the water into ice, and an ice bank 50 disposed under the ice making tray 47 to store ice separated from the ice making tray 47.

An ice transfer device 53 to transfer the stored ice, separated from the ice making tray 47, is installed in the ice bank 50, and a crushing chamber 60 in which an ice crushing device 56 to selectively crush the ice transferred by the ice transfer device 53 is installed is provided in front of the ice bank 50.

The ice transfer device 53 is provided with a spiral auger 55 which is rotated by a driving motor 54 to transfer the ice stored in the ice bank 50 to the crushing chamber 60.

The ice crushing device 56 includes a fixed blade 57 and a rotary blade 58 installed at the end of the auger 55, and generates ice cubes or crushed ice according to user selection.

The third cool air channel 30 includes a cool air supply duct 31 to supply cool air cooled by the second evaporator 26 to the ice making chamber 19, and a cool air return duct 32 to return cool air having cooled the ice making chamber 19 to the second evaporator 26.

A third circulation fan 33 to supply a part of the cool air generated by the second evaporator 26 to the cool air supply duct 31 is provided at the lower portion of the cool air supply duct 31, and cool air discharged to the ice making chamber 19 via the cool air supply duct 31 is guided by a cool air guide 63 installed below the ice making tray 47 and contacts the lower surface of the ice making tray 47.

The cool air guide 63 includes a cool air guide plate 64 separated from the lower surface of the ice making tray 47 by a designated interval and an ice making cool air channel 65 formed between the lower surface of the ice making tray 47 and the cool air guide plate 64.

Through such a configuration, cool air discharged from a cool air supply nozzle 34 disposed at the rear portion of the ice making chamber 19 to the ice making cool air channel 65 achieves heat exchange while colliding directly with the lower surface of the ice making tray 47, thereby improving ice making efficiency.

Although this embodiment illustrates the ice making device 41 as receiving cool air generated by the second evaporator 26 to cool the refrigerating chamber 21 and discharged to the ice making chamber 19, cool air generated by an evaporator separately installed in the ice making chamber 19 or generated through a refrigerant pipe directly contacting the ice making tray 47 may be used as cool air to make ice.

The doors 35 and 36 include a pair of refrigerating chamber doors 35 rotatably connected to the main body 10 to open and close the refrigerating chamber 20, and a drawer-type refrigerating chamber door 36 slidably connected to the main body 10 to open and close the freezing chamber 21.

A dispenser 37 allowing a user at the outside of the main body 10 to take beverages or ice out of the main body 10 is provided on the refrigerating chamber door 35.

The dispenser 37 includes a dispensing space 38 depressed from the outer surface of the refrigerating chamber door 35 by a designated depth so as to provide a space to dispense ice or beverages, and a lever 39 provided in the dispensing space 38 to perform dispensing operation of ice or beverages.

An ice movement path 40 communicating with the crushing chamber 60 is provided in the refrigerating chamber door 35 above the dispensing space 38. The ice movement path 40 is formed within the insulating material of the refrigerating chamber door 35 such that one end of the ice movement path 40 is connected to an ice outlet 62 formed on the crushing chamber 60 and the other end of the ice movement path 40 is connected to the upper portion of the dispensing space 38.

The ice outlet 62 is exposed to the outside when the refrigerating chamber door 35 is opened, and contacts the upper end of the ice movement path 40 when the refrigerating chamber door 35 is closed.

An opening and closing cover 48 to open and close the ice movement path 40 according to operation of the lever 39 is provided at the lower end of the ice movement path 40. The opening and closing cover 48 is rotatably connected to the upper portion of the dispensing space 38, and maintains an airtight state between the ice movement path 40 and the dispensing space 38 so as to prevent external air from being introduced into the ice movement path 40.

Through such a configuration, when a user operates the lever 39 to dispense ice, the opening and closing cover 48 is rotated and opens the ice movement path 40. Then, ice stored in the ice bank 50 is moved forwards by the ice transfer device 53 and the ice moved forwards is transferred to the crushing chamber 60 through an opened ice path 49.

The ice transferred to the crushing chamber 60 is discharged through the ice outlet 62 and is then supplied to the dispenser 37 via the ice movement path 40. If the user selects crushed ice, the ice supplied to the crushing member 60 is crushed by the ice crushing device 56 and is then supplied to the dispenser 37.

Since the ice stored in the ice bank 50 is transferred by the ice transfer device 53 due to continuous operation of the dispenser 37, the ice stored in the ice bank 50 may be accumulated around the ice path 49. In this case, cool air supplied to the crushing chamber 60 through the ice path 49 may be intercepted by the accumulated ice, and thus ice remaining in the crushing chamber 60 may melt.

Particularly, crushed ice remaining on the blades 57 and 58 of the ice crushing device 56 melts into water due to temperature rise of the crushing chamber 60, and water flows toward the dispenser 37 through the ice movement path 40 or drops down to the inside of the refrigerating chamber 20 through the ice outlet 62 when the refrigerating chamber door 35 is opened. Further, external air having a relatively high temperature is introduced into the crushing chamber 60 through the ice outlet 62 exposed to the refrigerating chamber 20 due to frequent opening and closing of the refrigerating chamber door 35, and thus the crushing chamber 60 maintains a higher temperature than the ice making chamber 19.

In order to prevent the ice remaining in the crushing chamber 60 from melting, the ice making device 41 in accordance with this embodiment includes a cool air supply channel 80 to supply a part of cool air supplied to the ice making chamber 19 to the crushing chamber 60.

Figure 3:
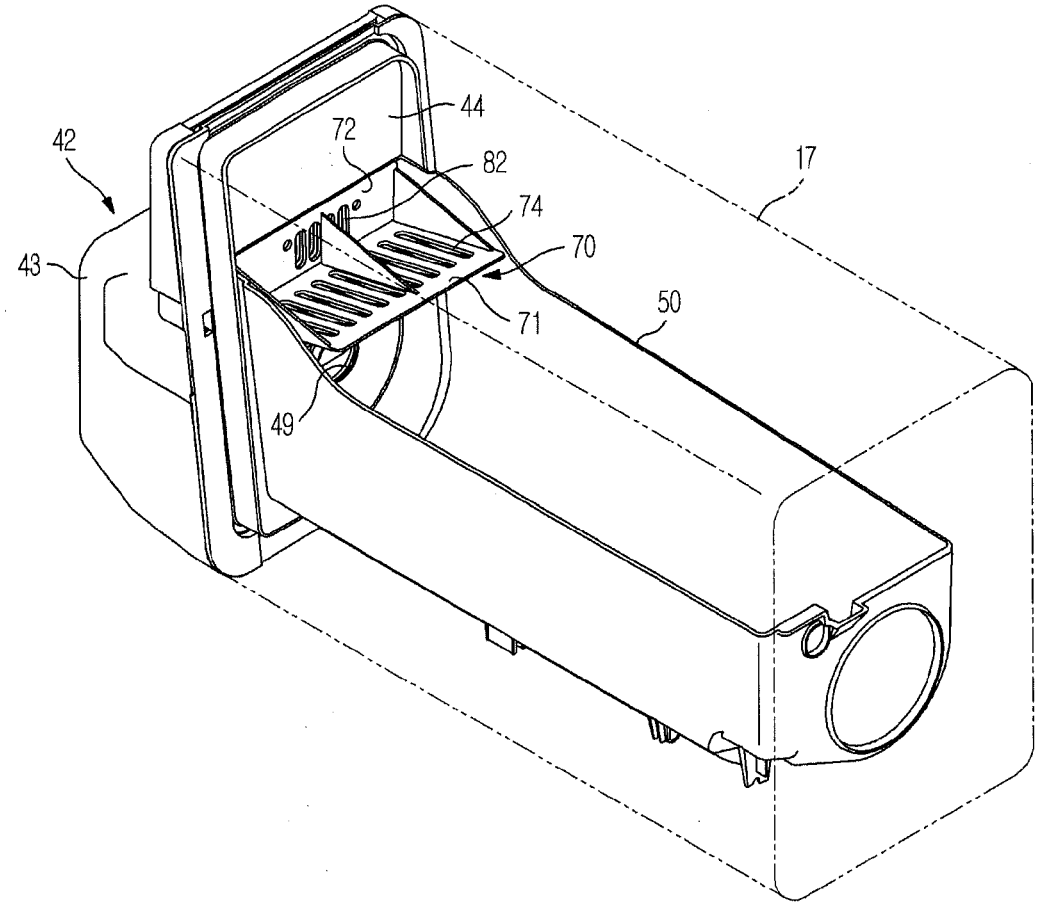
FIG. 3 is a perspective view illustrating an essential portion of an ice making device in accordance with the embodiment of the present disclosure.
Figure 4:
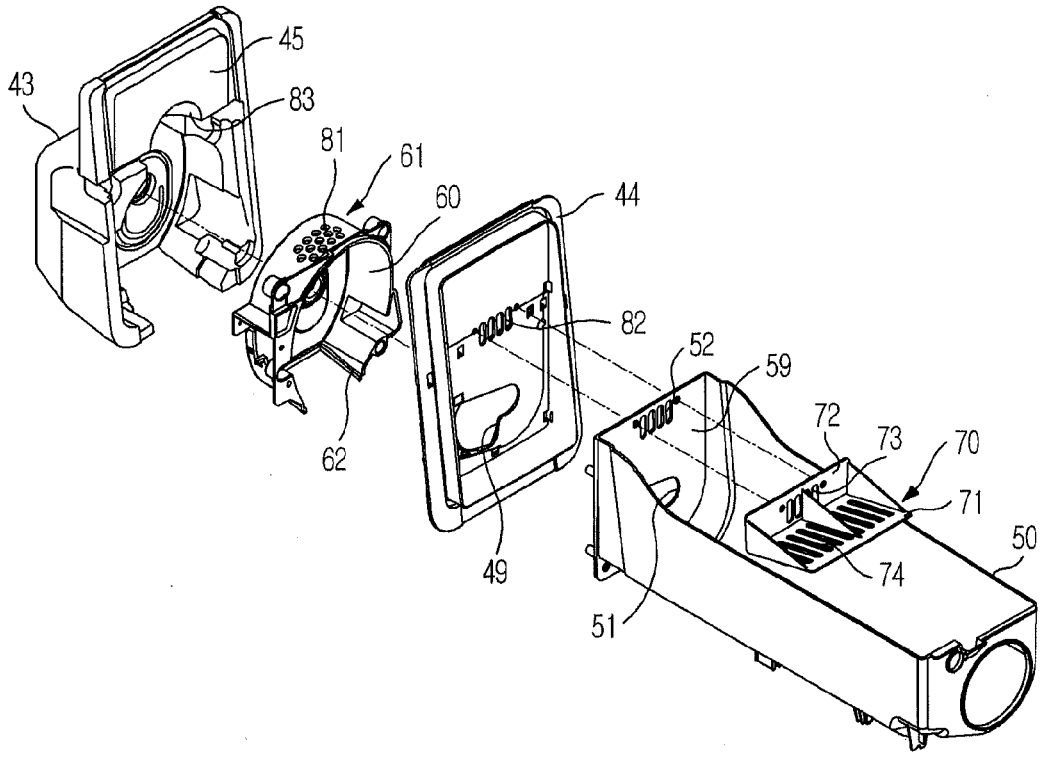
FIG. 4 is an exploded perspective view of the ice making device of FIG. 3.
Figure 5:
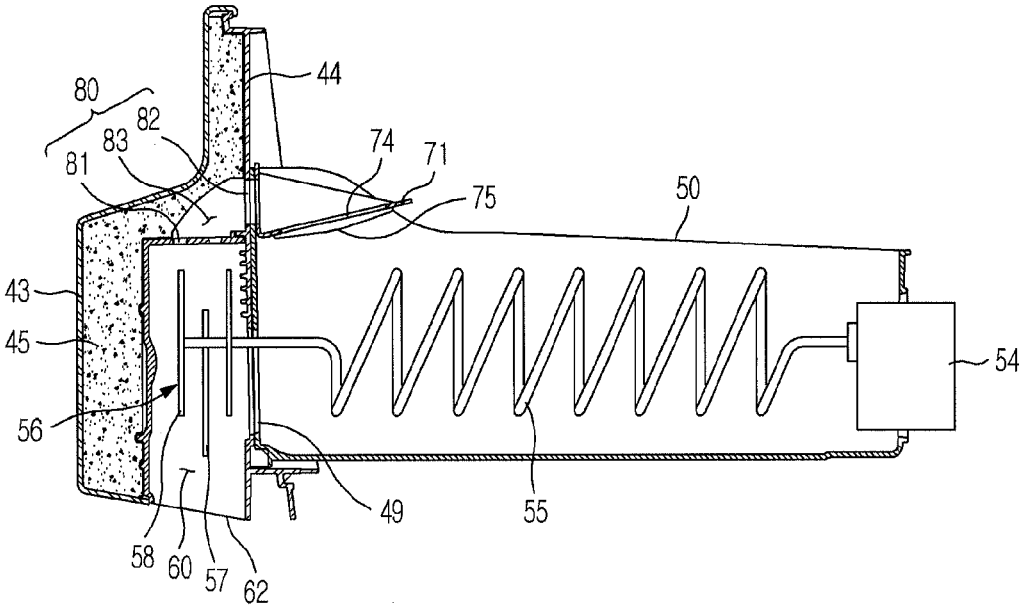
FIG. 5 is a cross-sectional view of the ice making device of FIG. 3.

FIG. 3 is a perspective view illustrating an essential portion of the ice making device in accordance with the embodiment of the present disclosure, FIG. 4 is an exploded perspective view of the ice making device of FIG. 3, and FIG. 5 is a cross-sectional view of the ice making device of FIG. 3.

With reference to FIGS. 3 to 5, the ice making device in accordance with this embodiment includes an ice making chamber door 42 to open and close the ice making chamber 19, and the ice bank 50 installed on the rear surface of the ice making chamber door 42 and moving integrally with the ice making chamber door 42.

An ice maker 46 to generate ice, as shown in FIG. 2, is installed on the ice bank 50, thereby closing one side of the opened upper surface of the ice bank 50.

Further, the ice maker 46 is provided such that the front surface of the ice maker 46 is separated from the rear surface of the ice making chamber door 42 by a designated interval when the ice making chamber door 42 closes the ice making chamber 19, and the upper surface of the ice bank 50 exposed, due to separation between the front surface of the ice maker 46 and the rear surface of the ice making chamber door 42, is covered with a cool air guide member 70 extended from the rear surface of the ice making chamber door 42. Such a cool air guide member 70 includes a cover part 71 extended from the rear surface of the ice making chamber door 42, and the cover part 71 serves to prevent ice accumulated in the ice bank 50 from being separated from the outside of the ice bank 50.

The crushing chamber 60 divided from the ice bank 50 and forming an independent space separately from the ice bank 50 may be formed at the inside of the ice making chamber door 42.

The ice making chamber door 42 includes an outer casing 43 to form the outer surface of the ice making chamber door 42, an inner casing 44 separated from the outer casing 43 by a regular interval to form the inner surface of the ice making chamber door 42 closing the ice making chamber 19, and an insulating material 45 disposed between the outer casing 43 and the inner casing 44 to prevent a cool air loss.

Further, a crushing chamber housing 61 to form a space divided from the ice bank 50 is installed between the insulating material 45 and the inner casing 44.

The crushing chamber housing 61 has an approximately cylindrical shape, one surface of which is opened, and the opened surface of the crushing chamber housing 61 is closed by the inner casing 44.

The ice outlet 62 communicating with the ice movement path 40 to supply ice to the dispenser 37 is formed at the lower portion of the crushing chamber housing 61, and at least one cool air discharge hole 81 through which cool air is discharged from the ice bank 50 is formed on the upper surface of the crushing chamber housing 61.

Although not shown in the drawings, an opening and closing member to open and close the ice outlet 62 may be installed at the ice outlet 62.

The ice path 49 opened so as to allow the end of the auger 55 installed in the ice bank 50 to pass through the ice path 49 is formed at the lower portion of the inner casing 44, and ice transferred by the auger 55 is transferred to the crushing chamber 60 through the ice path 49.

The end of the auger 55 is inserted into the crushing chamber 60 through the ice path 49, and the ice crushing device 56 provided with the blades 57 and 58 disposed at the end of the auger 55 to crush ice is disposed in the crushing chamber 60. Although this embodiment illustrates the ice crushing device 56 as being disposed in the crushing chamber 60, the crushing chamber 60 may include only a separate space to discharge ice stored in the ice bank 50 to the dispenser 37, i.e., a separate space provided with the ice outlet 62 communicating with the ice movement path 40 to drop the ice to the dispenser 37.

At least one cool air introduction hole 82 into which cool air in the ice bank 50 is introduced is installed at the upper portion of the inner casing 44.

The at least one cool air introduction hole 82 and the at least one cool air discharge hole 81 may communicate with each other through a connection channel 83 formed in the insulating material 45 installed on the inner surface of the ice making chamber door 42.

That is, the cool air supply channel 80 to supply cool air within the ice making chamber 19 to the crushing chamber 60 separately from the ice path 49 is formed in the ice making chamber door 42. As shown in FIG. 5, the cool air supply channel 80 is disposed above and adjacent to the ice path 49, and is formed between the inner casing 44 and the insulating material 45. The cool air supply channel 80 includes the at least one cool air discharge hole 81 formed on the upper portion of the crushing chamber 60, the at least one cool air introduction hole 82 formed on the upper portion of the inner casing 44, and the connection channel 83 formed in the insulating material 45.

The cool air supply channel 80 is provided at a higher position than the ice path 49, and thus allows cool air to be effectively supplied to the crushing chamber 60, although the ice path 49 is clogged with ice accumulated in the ice bank 50, thereby preventing ice remaining in the crushing chamber 60 from melting.

The ice bank 50 to store ice dropped from the ice making tray 47 is connected to the rear surface of the inner casing 44.

The ice bank is integrally connected to the ice making chamber door 42, and thus is slid into and out of the ice making chamber 19 in connection with opening and closing of the ice making chamber door 42.

The ice bank 50 has an approximately regular hexahedral shape, the upper surface of which is opened, a first opening 51 corresponding to the ice path 49 formed on the inner casing 44 is formed at the lower portion of a front surface 59 of the ice bank 50, and at least one second opening 52 corresponding to the at least one cool air introduction hole 82 formed on the inner casing 44 is formed at the upper portion of the front surface 59.

An opened part of the upper region of the rear portion of the ice bank 50 is covered with the lower surface of the ice maker 46 installed on the ice bank 50, thus preventing ice stored in the ice bank 50 from being separated to the outside.

Further, an opened part of the upper region of the front portion of the ice bank 50 is covered with the cool air guide member 70 connected to the rear surface of the inner casing 44.

The cool air guide member 70 includes a fixed part 72 connected to the rear surface of the inner casing 44 and the cover part 71 extended backwardly from the end of the fixed part 72.

At least one third opening 73 corresponding to the at least one second opening 52 formed at the upper portion of the front surface 59 of the ice bank 50 is formed on the fixed part 72, and cool air passing holes 74 are formed through the cover part 71 so as to guide cool air in the ice making chamber 19 to the at least one third opening 72.

A plurality of ice separation ribs 75 separated from each other and disposed in the width direction of the cover part 71 is provided on the lower surface of the cover part 71. The ice separation ribs 75 are extended downwardly from the lower surface of the cover part 71, and serve to prevent ice accumulated around the ice path 49 from clogging the cool air passing holes 74 formed through the cover part 71.

Figure 6:
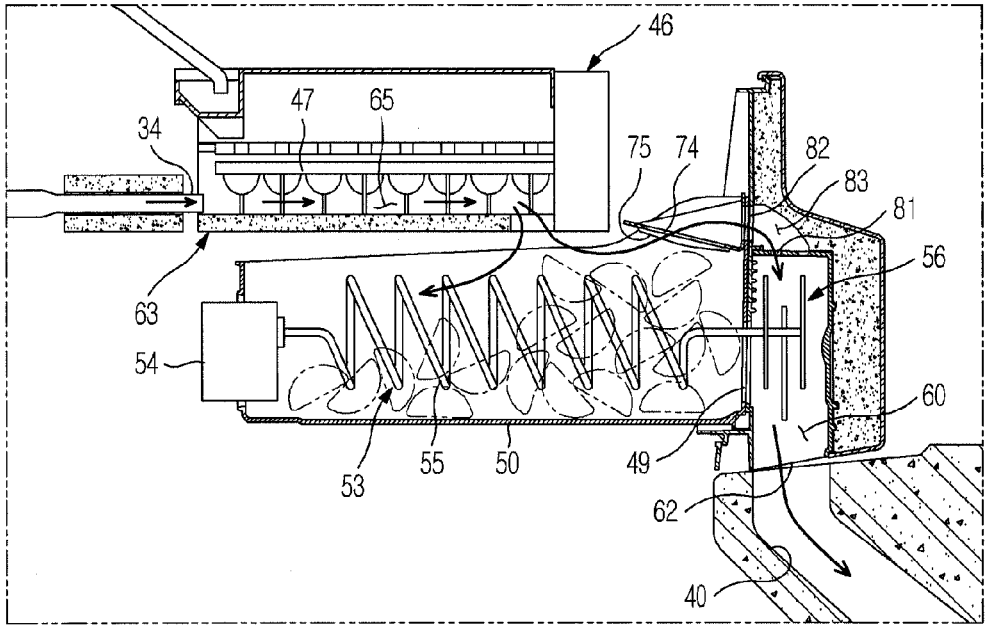
FIG. 6 is a view illustrating a cool air flow in the ice making device in accordance with the embodiment of the present disclosure.

Hereinafter, a flow path of cool air in the ice making device in accordance with this embodiment will be described. FIG. 6 is a view illustrating a cool air flow in the ice making device in accordance with this embodiment.

First, cool air of the freezing chamber 21 passes through the cool air supply duct 31 and is guided to the ice making chamber 19 by the cool air supply nozzle 34 provided at the rear portion of the ice making chamber 19. The cool air guided by the cool air supply nozzle 34 flows along the cool air guide 63 disposed below the ice making tray 47 and contacts the lower surface of the ice making tray 47, thus freezing water contained in the ice making tray 47 into ice. That is, the cool air supplied to the ice making chamber 19 is concentrated on the ice making tray 47 by the cool air guide 63, and thus ice making is effectively carried out with a small amount of cool air.

After freezing the water in the ice making tray 47 into ice, a part of the cool air discharged from the cool air guide 63 to the ice bank 50 cools ice stored in the ice bank 50.

Here, the part of the cool air discharged to the ice bank 50 is supplied to the crushing chamber 60 through the ice path 49 or the cool air supply channel 80 formed on the upper portion of the crushing chamber 60, thus cooling the crushing chamber 60.

Ice stored in the rear portion of the ice bank 50 is transferred forwards by the ice transfer device 53 due to repeated operation of the dispenser 37, and the ice transferred forwards is accumulated around the ice path 49 and thus supply of cool air toward the ice path 49 is intercepted.

Thereby, the temperature within the crushing chamber 60 rises, and thus ice remaining in the crushing chamber 60 may melt due to the temperature rise. Particularly, if the ice crushing device 56 is installed in the crushing chamber 60, crushed ice remaining on the blades 57 and 58 easily melts into water even by small temperature rise and thus the water flows toward the dispenser 37 or drops down to the inside of the refrigerating chamber 20 when the refrigerating chamber door 35 is opened, thereby lowering reliability of the refrigerator.

However, the cool air supply channel 80 in accordance with this embodiment effectively supplies cool air toward the crushing chamber 60 although the ice path 49 is clogged by accumulated ice, and thus prevents temperature rise of the crushing chamber 60 and melting of ice remaining in the crushing chamber 60 due to cooling of the remaining ice by the cool air introduced through the cool air supply channel 80. Further, cool air discharged to the lower portion of the crushing chamber 60 through the cool air supply channel 80 is directed to the ice outlet 62, thus functioning as an air curtain preventing external air of a high temperature from being introduced into the ice outlet 62 in a state in which the refrigerating chamber door 35 is opened.

Further, the cool air discharged to the crushing chamber 60 through the cool air supply channel 80 is supplied to the ice movement path 40 through the ice outlet 62 in a state in which the refrigerating chamber door 35 is closed, and thus cools the ice movement path 40, thereby preventing melting of remaining ice.

As is apparent from the above description, an ice making device and a refrigerator having the same in accordance with one embodiment of the present disclosure prevent water formed from melting of remaining ice from flowing to a dispenser space, thus improving reliability of the refrigerator.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a main body including a refrigerating chamber;

a door, including a dispenser to dispense ice, provided to open and close the refrigerating chamber;

an ice making chamber provided in the refrigerating chamber so as to be divided from the refrigerating chamber and including a front opening;

a cool air channel provided in the main body so as to circulate cool air in the ice making chamber;

an ice maker provided in the ice making chamber and including an ice making tray to generate ice due to cool air supplied to the ice making chamber;

an ice making chamber door provided to open and close the front opening of the ice making chamber and including an ice bank to store ice separated from the ice making the ice making chamber door includes an insulating material installed between an outer casing and an inner casing;

a crushing chamber forming a separate space in the ice making chamber door and including an ice crushing device to crush ice discharged from the ice bank to the dispenser;

an ice transfer device to transfer the ice stored in the ice bank to the crushing chamber; and an ice path to supply the ice transferred by the ice transfer device to the crushing chamber provided on the rear surface of the ice making chamber door; and a cool air supply channel to supply a part of the cool air supplied to the ice making chamber to the crushing chamber provided in the ice making chamber door, wherein the cool air supply channel is formed separately from the ice path, disposed above and adjacent to the ice path, and is formed between the inner casing and the insulating material where one end of the cool air supply channel communicates with the crushing chamber and the other end of the cool air supply channel communicates with the ice making chamber such that the cool air supply channel supplies the part of the cool air to the crushing chamber separately from the ice path.

2. The refrigerator according to claim 1, further comprising:

an ice movement path to drop ice toward the dispenser provided in the door; and an ice outlet provided in the crushing chamber to communicate with the ice movement path.

3. The refrigerator according to claim 1, further comprising a cool air guide to guide the cool air supplied to the ice making chamber so that the cool air contacts the lower surface of the ice making tray.

4. The refrigerator according to claim 3, further comprising a cool air guide member installed on the rear surface of the ice making chamber door so as to guide a part of cool air discharged from the cool air guide to the cool air supply channel.

5. The refrigerator according to claim 4, wherein the ice maker and the ice making chamber door are separated from each other by a designated distance if the ice making chamber door closes the ice making chamber, and the cool air guide member includes a cover part provided with cool air passing holes and covers the upper surface of the ice bank exposed due to the separation between the ice maker and the ice making chamber door.

6. The refrigerator according to claim 5, wherein the cool air guide member further includes ice separation ribs extended from the lower surface of the cover part.

7. The refrigerator according to claim 1, wherein the crushing chamber is formed by a crushing chamber housing connected between the insulating material and the inner casing.

8. The refrigerator according to claim 7, wherein the cool air supply channel includes:

at least one cool air introduction hole formed at the upper portion of the inner casing; and a connection channel formed in the insulating material so as to connect the at least one cool air introduction hole and at least one cool air discharge hole.

9. An ice making device installed in an ice making chamber including a front opening provided in a refrigerating chamber such that the ice making chamber is divided from the refrigerating chamber to form an independent space, the ice making device comprising:

an ice maker to freeze water stored in an ice making tray into ice;

an ice bank to store ice separated from the ice making tray;

a crushing chamber forming a closed space divided from the ice bank and provided with an ice outlet to discharge ice;

an ice transfer device installed in the ice bank so as to transfer the ice stored in the ice bank to the crushing chamber;

an ice path formed between the ice bank and the crushing chamber so as to supply the ice transferred by the ice transfer device to the crushing chamber; and a cool air supply channel connecting the ice bank and the crushing chamber to supply a part of the cool air having cooled the ice making tray to the crushing chamber, wherein the cool air supply channel is formed separately from the ice path, disposed above and adjacent to the ice path, and is formed between an inner casing and an insulating material surrounding the crushing chamber such that one end of the cool air supply channel communicates with the crushing chamber and the other end of the cool air supply channel communicates with the ice making chamber such that the cool air supply channel supplies he part of the cool air to the crushing chamber separately from the ice path.

10. The ice making device according to claim 9, further comprising an ice crushing device to crush the ice supplied by the ice transfer device provided in the crushing chamber.

11. The ice making device according to claim 9, further comprising a cool air guide disposed below the ice making tray to guide the supplied cool air so that the cool air contacts the lower surface of the ice making tray.

12. The ice making device according to claim 11, wherein the cool air supply channel includes:

at least one cool air introduction hole formed at the upper portion of a diaphragm provided with the ice path; and a connection channel formed in the insulating material surrounding the crushing chamber so as to connect the at least one cool air introduction hole and at least one cool air discharge hole.

13. The ice making device according to claim 12, wherein a cool air guide member to guide cool air, discharged to a portion above the ice path by the cool air guide, to the at least one cool air introduction hole is installed on the diaphragm.

14. The ice making device according to claim 13, wherein the cool air guide member includes a cover part extended from the diaphragm to the ice maker, and cool air passing holes to pass cool air are formed on the cover part.

15. The ice making device according to claim 14, wherein the cool air guide member further includes ice separation ribs extended from the lower surface of the cover part so as to prevent the cool air passing holes from being clogged with ice accumulated around the ice path.

16. A refrigerator comprising:

a main body in which a storage chamber is formed;

a door, including a dispenser and an ice movement path to transfer ice to the dispenser, provided to open and close the storage chamber;

an ice making chamber including a front opening provided in the refrigerating chamber to form an independent space divided from the refrigerating chamber;

an ice making device installed in the ice making chamber and including an ice maker to generate ice, an ice bank disposed below the ice maker and provided with an ice transfer device to transfer ice, an ice path into which the ice transferred by the ice transfer device is introduced, and a crushing chamber provided with an ice outlet connected to the ice movement path and divided from the ice bank; and a cool air supply channel provided with one end communicating with the crushing chamber and the other end communicating with a space in which the ice maker is disposed and supplying a part of cool air having cooled the ice maker to the crushing chamber so as to prevent ice remaining in the crushing chamber and the ice movement path from melting, wherein the cool air supply channel is formed separately from the ice path, disposed above and adjacent to the ice path, and is formed between an inner casing and an insulating material provided outside the crushing chamber such that one end of the cool air supply channel communicates with the crushing chamber and the other end of the cool air supply channel communicates with the ice making chamber such that the cool air supply channel supplies the part of the cool air to the crushing chamber separately from the ice path.

17. The refrigerator according to claim 16, wherein the ice maker further includes an ice making tray to contain water to be frozen into ice, and a cool air guide disposed below the ice making tray to guide the supplied cool air so that the cool air contacts the lower surface of the ice making tray.

18. The refrigerator according to claim 16, wherein the cool air supply channel includes at least one cool air introduction hole communicating with the ice making chamber and a connection channel formed in the insulating material so as to connect the at least one cool air introduction hole and at least one cool air discharge hole.

* * * * *